United States Patent [19]

Won

[11] 4,020,948

[45] May 3, 1977

[54] TENNIS BALL STORAGE CONTAINER

[76] Inventor: Lee Chun Won, 11-567 Yunhee-dong, Sudaemun, Seoul, South Korea

[22] Filed: July 7, 1975

[21] Appl. No.: 593,694

[30] Foreign Application Priority Data

Apr. 15, 1975 South Korea ..... 752003

[52] U.S. Cl. ..... 206/315 B; 215/352; 220/304; 220/378

[51] Int. Cl.[2] ..... B65D 41/04; B65D 53/02; B65D 85/00

[58] Field of Search ..... 206/315 B; 215/270, 215/341–346, 352; 220/8, 254, 304, 357–358, 378; 273/61 D

[56] References Cited

UNITED STATES PATENTS

| | | | |
|---|---|---|---|
| 2,712,394 | 7/1955 | Koschatzky et al. | 206/315 B X |
| 3,415,357 | 12/1968 | Van Natter | 206/315 B X |
| 3,819,040 | 6/1974 | Coons | 206/315 B |
| 3,897,874 | 8/1975 | Coons | 220/378 X |

*Primary Examiner*—Steven E. Lipman

[57] ABSTRACT

A tennis ball storage container is disclosed of the type wherein the balls located inside the container are maintained in a compressed air surrounding in order to prevent microscopic penetration of compressed air from inside the ball during the storage. The container comprises a cylindric storage container and a cylindric lid arranged to place over the container to close same. Sealing means are arranged on the container and on the lid which are effective to maintain a generally air tight sealing engagement between the container and the lid during the operation of placing the lid over said container. The sealing means prevents air present in the space defined by the container and the lid as the lid is being placed over the container. The sealing means prevents air present in the space defined by the container and the lid as the lid is being placed over the container. The volume defined by the inside of the lid amounts to at least two thirds of the volume defined by the container.

1 Claim, 2 Drawing Figures

TENNIS BALL STORAGE CONTAINER

The present invention relates to a tennis ball storage container of the type wherein the balls located inside the container are maintained in an environment of compressed air. More particularly, the present invention presents a further improvement of a tennis ball storage container as described in my copending application serial number.

The storage of tennis balls in a compressed air environment is of advantage as it prevents, to a substantial degree, the deterioration of mechanial qualities of tennis balls during their storage due to microscopic penetration of the compressed gas from inside the ball to the atmosphere. In general, this type of storage brings the pressure differential between the inside of the ball and its surrounding to at least zero; preferably, the pressure of the surrounding of the ball is slightly higher than that of the inside of the ball.

It is an object of the present invention to provide a particularly useful and relatively simple storage container of the above type.

According to the present invention, a tennis ball storage container is provided of the type wherein the balls are located inside a container and are maintained in the environment of compressed air. The container comprises a cylindric storage means and a cylindric lid arranged to be placed over the container to close the same. Sealing means are arranged between the container and the lid to effect and maintain a generally air tight sealing engagement of the two during the placing of the lid over the container, whereby air is substantially prevented from escaping from the space defined by the lid and by the container as the lid is being placed over the container. The volume of the inside of the container is equal to at least two thirds of that of the container, to secure sufficient compressin of the air inside the container, surrounding the balls therein.

Figure 1:
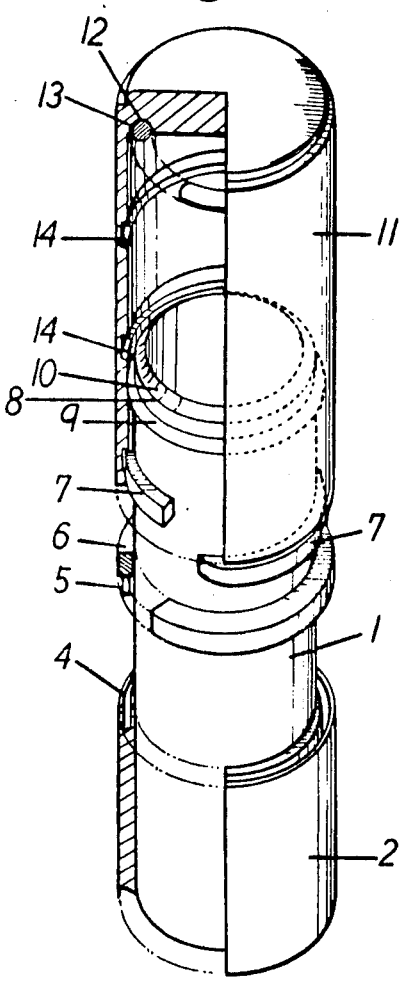
Figure 2:
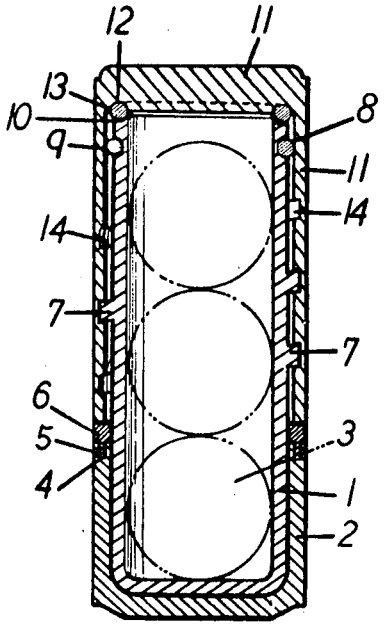

A preferred embodiment of the present invention will now be disclosed with reference to the accompanying drawing in which;

FIG. 1 is a perspective view, partly in section of the container according to the present invention; and FIG. 2 is a longitudinal vertical section of the container shown in FIG. 1, as in closed position.

The container of the present invention comprises a lower cylindric container 1 the inside diameter of which is slightly greater than the outside diameter of tennis balls so as to be capable of receiving 3 tennis balls one of top of the other, as indicated by broken lines in FIG. 2. The container 1 is fixedly embedded in an outside casing 2 which, as best seen in FIG. 2, reaches to approximately one third of the overall height of the container 1. The upper edge 4 of the casing 2 is suitably shaped to receive narrow bottom portion 5 of an elastic sealing ring 6, the ring 6 being disposed for a tight slidable movement on the outside surface of the container 1, above the edge 4 but below a peripheral spiral rib 7 disposed on the surface of the container 1 in the upper portion thereof. At the top of the container 1 a peripheral groove 8 is provided for receiving a seal ring 9 of circular cross-section (the ring 9 not shown in FIG. 1 for clarity). A lid is provided to close the container 1. As best seen from FIG. 2, the lid also is substantially cylindrical in shape and its inside volume corresponds to approximately two thirds of the volume of the container 1. The upper bottom of the lid 11 is provided with a circumferential, general axial groove 12 for receiving an annular elastic sealing ring 13 of generally circular cross-section. It will be observed from FIG. 2 that with the lid 11 in entirely closed position shown in FIG. 2, the sealing rings 9 and 13 are located close to each other, the ring 9 bearing against the inside wall of the lid 11, the ring 13 bearing generally against the upper circumferential edge of the container 1.

The upper part of the inside wall of the lid 11 is provided with a spiral groove 14 the cross-section of which is substantially the same as that of the rib 7, the pitch of the groove 14 also corresponding to that of the rib 7. The rib 7 and the groove 14 are arranged for a relatively tight but still sliding engagement which makes it possible to screw the lid 11 onto the container 1.

In operation, the balls 3 are placed into the container 1 as shown in FIG. 2 and the sealing ring 6 is positioned into proximity to the lower end of the rib 7. The lid 11 is then placed on top of the container 1 thus engaging at its opening the sealing ring 9. At the same time the rib 7 enters the beginning of the groove 14. Turning the lid 11 causes same to move axially downwardly with respect to the container 1. The seal 9 effectively prevents escape of the air which is now becoming compressed by the neutral movement of lid 11 with respect to container 1. At the same time, the rib 7 prevents the escape of the air from groove 14. The sealing effect of the rib 7 being further enhanced by the lower edge of the lid 11 engaging the top of sealing ring 6 and pushing same down until it engages with its bottom portion 5 the upper edge of the casing 2, whereupon the upper sealing ring 13 comes into engagement with a groove 10 in the upper peripheral edge of the container 1. Thus the compressed air cannot escape from within the container 1 due to the sealing ring 13 which now effects the primary sealing function.

It will thus be appreciated that according to the present invention the compression of the air inside the tennis ball storage container is effective by merely placing the lid 11 over the container 1 in the manner described.

It will be appreciated by those skilled in the art that the compression ratio depends on the height of the lid 11 or, put in other words, on the height of the portion of the container 1 protruding above the upper edge of the casing 2. I have found that with a container filled with tennis balls (e.g. tennis balls 3 as shown in FIG. 2), it is sufficient when the volume defined by the inside of the lid 11 amounts to approximately two thirds of that of the container.

It will be appreciated that the present invention can be modified to a greater or lesser degree without departing from the scope of the present invention as defined in the accompanying claim.

The embodiments of the present invention in which an exclusive property or privilege is claimed are defined as follows:

1. A tennis ball storage container of the type wherein the balls located inside the container are maintained in an environment of compressed air, said container comprising a cylindrical storage means; a cylindrical lid arranged to be placed over said container to close same; two sealing means between said container and said lid arranged to effect and to maintain a generally air tight sealing engagement between the container and the lid during and upon the placing of said lid over the container, whereby air is substantially prevented from escaping from the space defined by the lid and by the container as the lid is being placed over the container to close same, the first sealing means being located near the top of said container and abutting said container and lid to maintain a seal as the lid is applied, and the second sealing means being located at the top of the container and abutting the lid when it is in complete engagement with the container, the volume of the inside of the cylindrical lid being generally equal to two thirds of that of the container, and wherein the base of the container is surrounded by a casing, the cylindrical lid is in threadable engagement with the container and further sealing means are provided between said casing and said lid to seal the lid against the casing.

* * * * *